US009010227B1

(12) United States Patent
Dyuzhev et al.

(10) Patent No.: US 9,010,227 B1
(45) Date of Patent: Apr. 21, 2015

(54) METHOD FOR COMMERCIAL PRODUCTION OF SMALL-ARMS CARTRIDGE CASES

(71) Applicants: Oleg Dyuzhev, Kharkov (UA); Yuri Naumov, Kharkov (UA); Oleg Seleznev, Moscow (RU); Vadim Kasvin, Fort Lee, NJ (US)

(72) Inventors: Oleg Dyuzhev, Kharkov (UA); Yuri Naumov, Kharkov (UA); Oleg Seleznev, Moscow (RU); Vadim Kasvin, Fort Lee, NJ (US)

( * ) Notice: Subject to any disclaimer, the term of this patent is extended or adjusted under 35 U.S.C. 154(b) by 0 days.

(21) Appl. No.: 14/274,112

(22) Filed: May 9, 2014

Related U.S. Application Data

(60) Provisional application No. 61/876,871, filed on Sep. 12, 2013.

(51) Int. Cl.
*F42B 33/02* (2006.01)
*F42B 33/10* (2006.01)

(52) U.S. Cl.
CPC ..... *F42B 33/10* (2013.01)

(58) Field of Classification Search
CPC ..... B21K 23/00; B23B 1/00
USPC ..... 102/130–500; 29/2.21–2.25
See application file for complete search history.

(56) References Cited

U.S. PATENT DOCUMENTS

| | | | | | |
|---|---|---|---|---|---|
| 2,003,438 | A * | 6/1935 | Guignet | 72/354.2 |
| 2,402,068 | A * | 6/1946 | Meador | 148/643 |
| 2,462,851 | A * | 3/1949 | Fawcett et al. | 148/643 |
| 2,904,873 | A * | 9/1959 | Hild | 86/19.6 |
| 3,185,095 | A * | 5/1965 | Mayer et al. | 102/467 |
| 4,198,843 | A * | 4/1980 | Spence | 72/356 |
| 4,598,445 | A * | 7/1986 | O'Connor | 86/19.6 |
| 4,984,501 | A * | 1/1991 | Roller | 86/36 |
| 5,714,707 | A * | 2/1998 | Ruia | 86/49 |
| 6,192,561 | B1 * | 2/2001 | Bennett | 86/19.5 |
| 6,779,461 | B1 * | 8/2004 | Olson et al. | 102/439 |
| 2006/0075919 | A1 * | 4/2006 | Wiley et al. | 102/464 |
| 2007/0214992 | A1 * | 9/2007 | Dittrich | 102/469 |
| 2014/0083319 | A1 * | 3/2014 | Hay et al. | 102/464 |

* cited by examiner

*Primary Examiner* — Samir Abdosh
(74) *Attorney, Agent, or Firm* — Paul Diamond, Esq.; Diamond Law Office, LLC

(57) ABSTRACT

The invention provides methods for producing varying sizes and types of small firearm cartridge cases using earlier produced cartridge cases as work stock. The preexisting cartridge cases are subjected to a number of machining operations to obtain the desired different sizes and/or types of cartridge cases. The invention considerably shortens the production cycle and substantially decreases the costs of production versus the conventional method of manufacturing new cartridge cases.

26 Claims, 2 Drawing Sheets

A-A

METHOD FOR COMMERCIAL PRODUCTION OF SMALL-ARMS CARTRIDGE CASES

CROSS-REFERENCE TO RELATED APPLICATIONS

This application claims the benefit of U.S. provisional patent application Ser. No. 61/876,871 filed Sep. 12, 2013, which is hereby incorporated by reference in its entirety.

FIELD OF THE INVENTION

The invention relates to the field of manufacturing firearm ammunition.

BACKGROUND OF THE INVENTION

Today, like 50 years ago, the conventional method for commercial production of small-arms cartridge cases involves a successive performance of an extensive range of auxiliary and basic manufacturing operations: cutting-down sheet materials (brass, bimetal or low-carbon steel) into strips, performance of around 8 stamping operations—circle-type blanking, folding a circle into a cap, four drawing and thinning operations (including intermediate thermal and chemical operations), two stamping operations to produce a primer socket, forming two priming openings (as applied to Berdan system primers), as well as performance of at least three turning operations. Used as equipment to implement the above method are power crank presses of different types, including appropriate accessories, heat-treating furnaces, chemical baths and special automatic machines or sets of special-purpose automatic rotor lines.

The conventional system of recycling of cartridge cases, which is applied from time to time, employs case scrap melting followed by de novo manufacturing of new cartridge cases from the recovered metal. Thus, with the conventional method of recycling, vast material and manpower resources that were expended in the original manufacture are irrecoverably wasted, following the intended use of cartridges or their disposal.

What is needed and provided by the present invention are new methods for remanufacturing used or discarded cartridge cases which convert preexisting cartridge cases of one size and/or type to another size and/or type.

SUMMARY OF THE INVENTION

The invention provides methods for converting by way of a number of machining operations, a centerfire firearm cartridge case of one size and type to a centerfire firearm cartridge case of a different size and/or type.

One embodiment of the invention provides a method for modifying a preexisting metallic centerfire firearm cartridge case having a bottom and top and overall length there-between, a terminal base portion disposed near the bottom that comprises an externally presented circular rim and an annular groove above the rim and an internally extending central primer pocket having an inner diameter and extending from the bottom of the cartridge toward the top of the cartridge within the base portion, a propellant chamber extending from the base portion toward the top of the cartridge case, the propellant chamber having a bottom wall with at least one flash hole formed therein between the propellant chamber and primer pocket, the method including the steps of: applying radially inward directed pressure about the rim and annular groove of the cartridge to reduce the inner diameter of the primer pocket, whereby the inner diameter of the primer pocket is reduced. The step of applying radially inward directed pressure in the referenced embodiments may include radially crimping the base portion of the cartridge case about the rim and annular groove using a multi-segment mandrel including a plurality of circumferentially disposed segments, each segment comprising a cartridge case contacting portion.

The method may further include the step of: inserting a terminal portion of a cylindrical mandrel into the primer pocket before the step of applying radially inward directed pressure about the rim and annular groove of the cartridge, the cylindrical mandrel remaining inserted in the primer pocket during said application of radially inward directed pressure, wherein the terminal portion of the cylindrical mandrel is sized and configured to provide preselected dimensions of the primer pocket pursuant to said application of radially inward directed pressure.

The method may further include the step of: after the step of applying radially inward directed pressure, inserting into the top opening of the cartridge case a rigid cylindrical member having a flat bottom, such as a cylindrical punch; and pressing the flat bottom of the cylindrical member to the seat to flatten the seat, while the bottom of the cartridge and the primer pocket is supported by a/the mandrel abutting the bottom of the cartridge and having a terminal portion inserted into the primer pocket.

The method may further include the step of: inserting through the top of the cartridge case a punch member completely into cartridge case, the outer dimensions of the punch member selected to impart a new inner and outer dimension to the propellant chamber of the cartridge case upon passing the cartridge case with the punch member inserted therein through a die; and passing the cartridge case with the punch member completely inserted therein through the die moving from the base to the top of the cartridge, whereby the new inner and outer dimensions are obtained.

In one variation, the preexisting cartridge case is a Berdan primer configured cartridge case and the method further includes the step of: forming a central, axially oriented (longitudinal) hole passing from the primer pocket to the propellant chamber, whereby the Berdan primer configured cartridge case is converted to Boxer primer compatible configured cartridge case.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION

Figure 1:
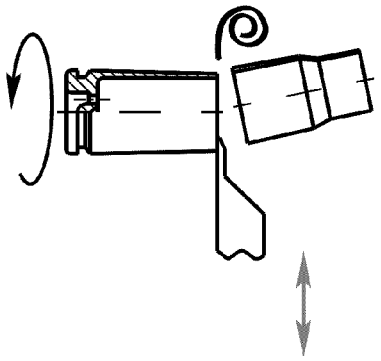
FIG. 1 shows the step of trimming of the upper part of a preexsiting initial bottleneck cartridge case body to remove the shoulder and neck portions of the case.

The invention is applied to the sphere of production of ammunition—small-arms cartridge cases of the most common designs, i.e., cases featuring annular grooves and having rims (circular flanges) that do not extend radially beyond the maximum outer diameter of the rest of the case (also known as "rimless" cartridge cases).

The invention provides a method for commercial production of cases intended to be used as part of small-arms cartridges of various calibers and types and to be furnished with different-type primers of Berdan and Boxer primer systems. The method involves applying a range of shaping operations to preexisting small-arms cartridge cases to change some or all of the following parameters: type and caliber of cases, type of applicable primers, both involving the recurrence of the source system of primers and switching the Berdan system over to the Boxer system.

Two basic sources of preexisting cartridge cases ("work stock") that can be used to produce new-type cartridge cases exist: work pieces separated from loaded cartridges by firing them in shooting grounds or shooting galleries, with their further rework, using special automatic equipment, to remove spent primer bodies and scale; and work pieces separated from cartridges subject to disposal owing to expiration of the guaranteed storage life or their moral wear (and, hence, withdrawal from service) by the low-deformation unfixing method with the use of automatic rotor lines, or by some other methods. Notably, while a vast supply of work stock is readily available, it is currently grossly underutilized. The present invention advantageously permits recycling (reuse) of a good part of the resources that were expended in the original manufacture, thus reducing the production cycle and attaining a considerable decrease in the cost of the resulting new cartridge cases in comparison to the conventional method of de novo manufacture. In comparison to the standard case manufacturing method with its numerous operations, the method of the present invention may involve the use of 1-4 shaping operations, about three turning operations and no blanking and heat-treatment operations.

The present invention may use as work pieces small-arms cartridge cases of many types, having annular grooves. In one aspect, by performing a combination of operations selected from:

radial swaging of the primer opening zone, axial swaging-straightening of the case and flange bottom, application of a new mark, anvil height-wise calibration to make the central hole, making changes to the flange and annular groove sizes, and drawing to shape the case outer and inner surfaces, the invention provides that cartridge cases of one size (such as caliber) and type can be converted on a commercial scale to cartridge cases of many other sizes (such as calibers) and/or types, including without limitation changing the primer-type compatibility of the cartridge case, for example, from the Berdan primer system to the Boxer system.

Example

According to the one method embodiment, cases of cartridges of type 7.62x39 (for "Kalashnikov" system automatic arms), designed for Berdan primers, type KV-24, can be used to produce the following:

at least 10 types of cases for live, sports or blank cartridges of 9 mm caliber, including those for 9x19 Parabellum, the commonly used pistol cartridge, the entire line of cases for cartridges of 40 mm caliber, including 10 mm Auto, cases for "bottle-form" live or blank cartridges, including those for pistol (357 SIG) and rifle cartridges, having minimum caliber of 7.62 mm.

Primers of different types, including KV-26 of the Berdan system, small pistol primer (SPP), large pistol primer (LPP), small rifle primer (SRP) or large rifle primer (LRP) of the Boxer system can, according to the invention, be made applicable to and compatible with the above-mentioned cartridge cases.

According to the method of the invention, cases for most types of annular-groove cartridges can be used to produce new cases for small-arms cartridges of different types and calibers. It may be noted in this case that the stocks of both small-arms cartridges, having their guaranteed storage life expired, and spent cases are enormous. The invention advantageously provides a method for replenishing stocks of cartridge cases, including those of the most high-demand and advanced types without incurring the expenditures of de novo manufacturing.

A method embodiment of the invention, suited for commercial production of cartridge cases fit for fighting, sports or hunting arms, is explained through description of operations being sufficient to produce cases for pistol cartridges of Parabellum 9×19 type, to fit Berdan primers of type KV-26 or Boxer "small pistol primers," with respect to the accompanying figures, as follows.

Figure 2:
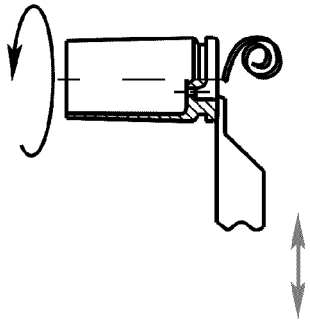
FIG. 2 shows the step of removing the previous marking (stamp) from the base of the cartridge case.
Figure 3:
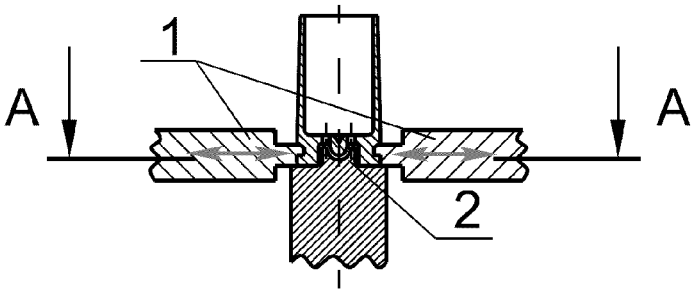
FIG. 3 shows the step of radial crimping of the flange and annular groove area of the cartridge case.
Figure 3:
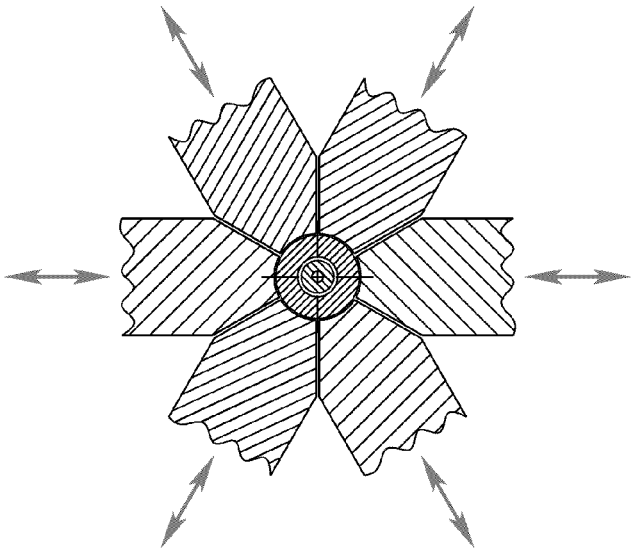
Figure 4:
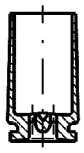
FIG. 4 shows the deformation of the flange and cartridge case inside bottom into a plate shape resulting from the radial crimping step.
Figure 5:
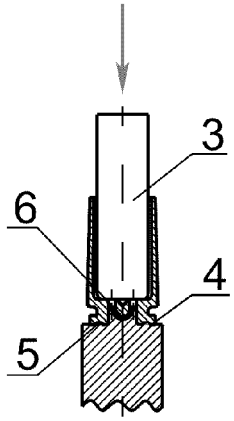
FIG. 5 shows the step axial crimping-lining of the flange and cartridge case inside bottom with simultaneous formation of the radius in the primer pocket, marking and correction of the dimension between the anvil and the flange surface.
Figure 7:
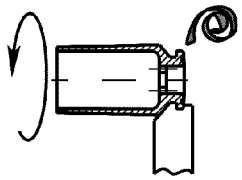
FIG. 7 shows the step of machining the dimensions of the circular flange and annular groove to preselected outer diameters and chamfers.
Figure 8:
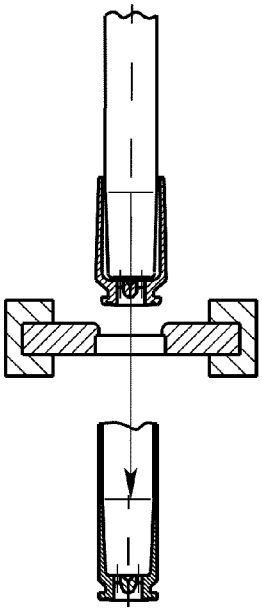
FIG. 8 shows the step of passing the cartridge case through a die using a punch inserted in the case in order to provide the barrel of the cartridge case with new preselected inner and outer dimensions.
Figure 9:
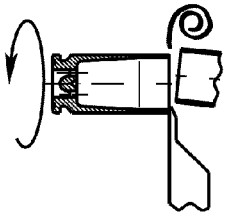
FIG. 9 shows a truncation step in which a top portion of the cartridge case is removed to provide a preselected overall length, following the elongation (stretching) of the cartridge from the die operation.

The embodiment implies production of such cases, involving the use of work pieces (preexisting cartridge cases) of ГЖ ("GZh") or ГС ("GS") types according to the USSR classification, 7.62 mm caliber, intended to fit the KV-24, Berdan-system primer and applicable to commonly used cartridges of type 7.62x39 (1943-pattern cartridges, 7.62 mm caliber), through performance of the following operations:

the upper part of the work piece case, including the sleeve and barrel, is cut off (FIG. 1)—the size from the flange to the cutting line is chosen, depending on the new case length, with the reference to preset case of about 18 mm;

the resulting work piece is de-varnished, washed and dried (only in respect for work pieces of ГС type);

the old mark is faced off from the work piece flange base (FIG. 2)—grooving depth is about 0.2 mm;

to decrease the primer socket bore diameter (as applied to the KV-26 primer or "small pistol primer" to be set instead of the standard KV-24 primer), the case work piece is subject to a simultaneous radial swaging operation (FIG. 3), using the multi-segment mandrel 1, to swage the outer edge of the flange, as well as cylindrical and conical parts of the annular groove while cylindrical mandrel 2 is placed inside the primer socket to shape the primer seat and lead-in radius—mandrel 2 may remaining in the primer pocket for the subsequent;

the bottom part and flange of the case work piece are then subjected to an axial swaging-straightening operation, to remove the concave deformation of the surface that resulting from the radial swaging (FIG. 4) by applying axial force to the case bottom using tool 3 (FIG. 5), which may be cylindrical. The flange 4 plane is pressed against the top peripheral surface of mandrel 2 during this process and, thus, marking 5 (restamping/remarking when the top peripheral surface of the mandrel includes raised features for impression) and correction of the axial dimension from the apex of the anvil 6 to the flange plane may be performed simultaneously with the straightening operation if desired. After the axial swaging-straightening operation is completed, mandrel 2 is removed from the primer socket;

if the Berdan primer system is to be changed to the Boxer system, a central hole 7 is made in the work piece "anvil" point (FIG. 6); the operation can be performed jointly with the operation of axial swaging-straightening of the flange, or separately from it;

the annular groove (conical and cylindrical parts) and outer diameter and face of the flange are machined reducing the outer diameter of the flange (FIG. 7) using, for example, a shaping tool or a tool designed to perform the transverse and longitudinal cutting functions simultaneously;

two drawing operations (FIG. 8) are successively performed to shape the outer wall (using a die) and inner wall (using a punch) of the new cartridge case;

excessive case length is cut off from the top of the cartridge case barrel (FIG. 9) to provide for the preselected lengthwise dimensions; and protective galvanic and/or other operations may be performed.

In the case of manufacturing bottleneck cases, a crimp-forming (shoulder and neck-forming) operation is performed, either before or after final lengthwise trimming The invention provides that preexisting cartridge case of the "cylindrical" form (non-bottleneck cases) may be used to produce a number of case types with a decreased caliber which may be of cylindrical form or bottleneck form. The invention also provides that preexisting bottleneck cases may be used to produce new cylindrical cases having a caliber increase versus the original work stock as well as new bottleneck cases having decreased caliber versus the original work stock. The length and geometrical dimensions of the cases are produced depending upon the designation and design of the cartridge. The types and caliber of new cases may be selected based on existing series of cartridge cases or, if desired, based on custom specifications according to which a new type and caliber may be produced.

Without limitation, the invention also provides the following embodiments and variations thereof. References to the figures are intended to be exemplary and not limiting of the recited embodiments.

One embodiment of the invention provides a method for modifying a preexisting metallic (brass, steel, etc.) centerfire firearm cartridge case having a bottom and top and overall length there-between, a terminal base portion disposed near the bottom that comprises an externally presented circular rim and an annular groove above the rim and an internally extending central primer pocket having an inner diameter and extending from the bottom of the cartridge toward the top of the cartridge within the base portion, a propellant chamber extending from the base portion toward the top of the cartridge case (including the portion for the bullet/projectile), the propellant chamber having a bottom wall with at least one flash hole formed therein between the propellant chamber and primer pocket, the method including the steps of: applying radially inward directed pressure about the rim and annular groove of the cartridge to reduce the inner diameter of the primer pocket, whereby the inner diameter of the primer pocket is reduced.

The step of applying radially inward directed pressure may include: radially crimping the base portion of the cartridge case about the rim and annular groove using a multi-segment mandrel comprising a plurality of circumferentially disposed segments, each segment comprising a cartridge case contacting portion. (E.g., see FIGS. 3A and 3B). The cartridge case-contacting portion of each segment may be complementarily sized and configured to engage a circumferential portion of the rim (the circular flange) and groove of the cartridge case whilst applying radially inward directed pressure. (E.g., as shown in FIG. 3A)

The method may further include a step of: inserting a terminal portion of a cylindrical mandrel into the primer pocket before the step of applying radially inward directed pressure about the rim and annular groove of the cartridge, the cylindrical mandrel remaining inserted in the primer pocket during said application of radially inward directed pressure. In this case, the terminal portion of the cylindrical mandrel may be sized and configured to reflect/provide preselected dimensions of the primer pocket pursuant to said application of radially inward directed pressure.

The method may include a step of: before or concurrent with the step of applying radially inward directed pressure, trimming the preexisting cartridge case to a preselected overall length by removing a top portion thereof, such as by cutting or grinding. (E.g., see FIG. 1.) The preexisting cartridge case may, for example, be a bottleneck cartridge case comprising a shoulder portion and a neck portion above the shoulder portion and the step of trimming the preexisting cartridge case to a preselected overall length by removing a top portion thereof may include truncating the preexisting cartridge case below the shoulder portion.

The preexisting cartridge case may have formed in the bottom of the base portion of cartridge case, stampings (embossed characters) such as those identifying features of the preexisting cartridge, and the method may further include a step of removing metal from the bottom of the cartridge case to remove the stampings. Said removal of material (metal) may be performed using a cutting or grinding tool, such as to shave off or grind off a preselected depth of material from the bottom of the cartridge case, for example, about or equal to 0.2 mm. (E.g., see FIG. 2.)

The method may include the steps of: after the step of applying radially inward directed pressure, inserting into the top opening of the cartridge case a cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket. In this manner, surface curvature introduced to the inside seat of the propellant chamber of the cartridge case in one or more prior steps is removed or reduced to an acceptable degree.

The method may include a step of: reducing the outer diameter of the flange (rim) to a preselected diameter for example, by machining the outward facing edge of the flange using a cutting or grinding tool. (E.g., see FIG. 7.)

The method may include the steps of: inserting through the top of the cartridge case a punch member completely into cartridge case, the outer dimensions of the punch member selected to impart new preselected inner and outer dimensions to the propellant chamber of the cartridge case upon passing the cartridge case with the punch member inserted therein through a die; and passing the cartridge case with the punch member completely inserted therein through the die moving from the base to the top of the cartridge, whereby the new inner and outer dimensions are obtained. (E.g., see FIG. 8.) The new inner and outer dimensions (diameters) may be smaller than the original inner and outer diameters of the propellant chamber portion of the original preexisting cartridge case. The passing step may increase the overall length of the cartridge case and the method may further comprises a step of: after the passing step, trimming the cartridge case to a preselected overall length by removing a top portion thereof, for example by cutting or grinding off a top portion of the cartridge case. (E.g., see FIG. 9.) Following the foreshortening of the cartridge case, if desired, the cartridge case may be formed into a bottleneck case configuration, for example, using conventional methods.

Figure 6:
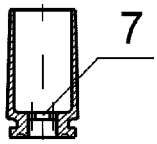
FIG. 6 shows the resulting central flash hole formed in place of the Berdan-style anvil to convert the cartridge case from the Berdan system to the Boxer system.

The method may also include a step for converting a Berdan-type cartridge case having an integral anvil that protrudes from the top of the primer pocket downward (for use with Berdan-compatible primers; e.g., see FIG. 4) to a Boxer-type cartridge case having a central flash hole for receiving a Boxer-type primer having a primer-integrated anvil (e.g., see FIG. 6). Thus, when the preexisting cartridge case is a Berdan primer configured cartridge case, the method may further include a step of: forming a central, axially oriented hole (i.e., opening, passageway) passing from the primer pocket to the propellant chamber, whereby the Berdan primer configured cartridge case is converted to Boxer primer compatible configured cartridge case. The central anvil of the Berdan case is essentially removed in the process of forming the central flash hole. The operation may, for example, be performed using a drill bit or a punch, with or without a counterpunch.

Once the new cartridge case types are produced in final form according to invention, they may be loaded with propellant and projectiles by, for example, conventional processes known in the art.

The various manufacturing operations described herein may be performed manually and/or by automated processes, such as in a fully automated process.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A method for modifying a preexisting metallic centerfire firearm cartridge case having a bottom and top and overall length there-between, a terminal base portion disposed near the bottom that comprises an externally presented circular rim and an annular groove above the rim and an internally extending central primer pocket having an inner diameter and extending from the bottom of the cartridge toward the top of the cartridge within the base portion, a propellant chamber extending from the base portion toward the top of the cartridge case, the propellant chamber having a bottom wall with at least one flash hole formed therein between the propellant chamber and primer pocket, the method comprising the steps of:

applying radially inward directed pressure about the rim and annular groove of the cartridge to reduce the inner diameter of the primer pocket, whereby the inner diameter of the primer pocket is reduced.

2. The method of claim 1, wherein the step of applying radially inward directed pressure comprises:

radially crimping the base portion of the cartridge case about the rim and annular groove using a multi-segment mandrel comprising a plurality of circumferentially disposed segments, each segment comprising a cartridge case contacting portion.

3. The method of claim 2, wherein the cartridge case contacting portion of each segment is complementarily sized and configured to engage a circumferential portion of the rim and groove of the cartridge case whilst applying radially inward directed pressure.

4. The method of claim 1, further comprising the step of:

inserting a terminal portion of a cylindrical mandrel into the primer pocket before the step of applying radially inward directed pressure about the rim and annular groove of the cartridge, the cylindrical mandrel remaining inserted in the primer pocket during said application of radially inward directed pressure, wherein the terminal portion of the cylindrical mandrel is sized and configured to provide preselected dimensions of the primer pocket pursuant to said application of radially inward directed pressure.

5. The method of claim 2, further comprising the step of:

inserting a terminal portion of a cylindrical mandrel into the primer pocket before the step of applying radially inward directed pressure about the rim and annular groove of the cartridge, the cylindrical mandrel remaining inserted in the primer pocket during said application of radially inward directed pressure, wherein the terminal portion of the cylindrical mandrel is sized and configured to provide preselected dimensions of the primer pocket pursuant to said application of radially inward directed pressure.

6. The method of claim 3, further comprising the step of:

inserting a terminal portion of a cylindrical mandrel into the primer pocket before the step of applying radially inward directed pressure about the rim and annular groove of the cartridge, the cylindrical mandrel remaining inserted in the primer pocket during said application of radially inward directed pressure, wherein the terminal portion of the cylindrical mandrel is sized and configured to provide preselected dimensions of the primer pocket pursuant to said application of radially inward directed pressure.

7. The method of claim 1, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

8. The method of claim 2, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

9. The method of claim 3, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

10. The method of claim 4, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

11. The method of claim 5, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

12. The method of claim 6, further comprising the steps of:

after the step of applying radially inward directed pressure, inserting into the top opening of the cartridge case a rigid cylindrical member having a flat bottom; and pressing the flat bottom of the cylindrical member to the seat to flatten the seat, while the bottom of the cartridge and the primer pocket is supported by a mandrel abutting the bottom of the cartridge and having a terminal portion inserted into the primer pocket.

13. The method of claim 1, further comprising the step of:

reducing the outer diameter of the flange.

14. The method of claim 2, further comprising the step of:

reducing the outer diameter of the flange.

15. The method of claim 4, further comprising the step of:

reducing the outer diameter of the flange.

16. The method of claim 7, further comprising the step of:

reducing the outer diameter of the flange.

17. The method of claim 1, further comprising the step of:

inserting through the top of the cartridge case a punch member completely into cartridge case, the outer dimensions of the punch member selected to impart new preselected inner and outer dimension to the propellant chamber of the cartridge case upon passing the cartridge case with the punch member inserted therein through a die; and passing the cartridge case with the punch member completely inserted therein through the die moving from the base to the top of the cartridge, whereby the new preselected inner and outer dimensions are obtained.

18. The method of claim 17, wherein the passing step increases the overall length of the cartridge case and the method further comprises the step of:

after the passing step, trimming the cartridge case to a preselected overall length by removing a top portion thereof.

19. The method of claim 2, further comprising the step of:

inserting through the top of the cartridge case a punch member completely into cartridge case, the outer dimensions of the punch member selected to impart new preselected inner and outer dimension to the propellant chamber of the cartridge case upon passing the cartridge case with the punch member inserted therein through a die; and passing the cartridge case with the punch member completely inserted therein through the die moving from the base to the top of the cartridge, whereby the new preselected inner and outer dimensions are obtained.

20. The method of claim 13, further comprising the step of:

inserting through the top of the cartridge case a punch member completely into cartridge case, the outer dimensions of the punch member selected to impart new preselected inner and outer dimension to the propellant chamber of the cartridge case upon passing the cartridge case with the punch member inserted therein through a die; and passing the cartridge case with the punch member completely inserted therein through the die moving from the base to the top of the cartridge, whereby the new preselected inner and outer dimensions are obtained.

21. The method of claim 1, wherein the preexisting cartridge case is a Berdan primer configured cartridge case and the method further comprises the step of:

forming a central, axially oriented hole passing from the primer pocket to the propellant chamber, whereby the Berdan primer configured cartridge case is converted to Boxer primer compatible configured cartridge case.

22. The method of claim 2, wherein the preexisting cartridge case is a Berdan primer configured cartridge case and the method further comprises the step of:

forming a central, axially oriented hole passing from the primer pocket to the propellant chamber, whereby the Berdan primer configured cartridge case is converted to Boxer primer compatible configured cartridge case.

23. The method of claim 13, wherein the preexisting cartridge case is a Berdan primer configured cartridge case and the method further comprises the step of:

forming a central, axially oriented hole passing from the primer pocket to the propellant chamber, whereby the Berdan primer configured cartridge case is converted to Boxer primer compatible configured cartridge case.

24. The method of claim 17, wherein the preexisting cartridge case is a Berdan primer configured cartridge case and the method further comprises the step of:

forming a central, axially oriented hole passing from the primer pocket to the propellant chamber, whereby the Berdan primer configured cartridge case is converted to Boxer primer compatible configured cartridge case.

25. The method of claim 1, further comprising the step of:

before or concurrent with the step of applying radially inward directed pressure, trimming the preexisting cartridge case to a preselected overall length by removing a top portion thereof.

26. The method of claim 1, wherein the preexisting cartridge case is a bottleneck cartridge case comprising a shoulder portion and a neck portion above the shoulder portion and the step of trimming the preexisting cartridge case to a preselected overall length by removing a top portion thereof comprises:

truncating the preexisting cartridge case below the shoulder portion.

* * * * *